US009322569B2

(12) United States Patent
Scharf et al.

(10) Patent No.: US 9,322,569 B2
(45) Date of Patent: Apr. 26, 2016

(54) SYSTEMS AND METHODS FOR A MOTORIZED VENT COVERING IN AN ENVIRONMENT CONTROL SYSTEM

(75) Inventors: Richard Scharf, Escondido, CA (US); Roger Heald, San Diego, CA (US)

(73) Assignee: HARMONIC DESIGN, INC., Poway, CA (US)

( * ) Notice: Subject to any disclaimer, the term of this patent is extended or adjusted under 35 U.S.C. 154(b) by 907 days.

(21) Appl. No.: 12/772,900

(22) Filed: May 3, 2010

(65) Prior Publication Data

US 2011/0269389 A1 Nov. 3, 2011

(51) Int. Cl.

| | |
|---|---|
| ***F24F 13/06*** | (2006.01) |
| ***F24F 13/14*** | (2006.01) |
| ***F24F 13/15*** | (2006.01) |
| ***F24F 11/053*** | (2006.01) |
| *F24F 11/00* | (2006.01) |

(52) U.S. Cl.

CPC ..... *F24F 13/1426* (2013.01); *F24F 11/053* (2013.01); *F24F 13/15* (2013.01); *F24F 11/0012* (2013.01); *F24F 2011/0049* (2013.01); *F24F 2011/0068* (2013.01); *F24F 2013/1433* (2013.01)

(58) Field of Classification Search

CPC ..... F24F 13/10

USPC ..... 454/254, 258, 284, 286, 289, 290, 292, 454/152, 155, 69, 196

See application file for complete search history.

(56) References Cited

U.S. PATENT DOCUMENTS

| | | | | |
|---|---|---|---|---|
| 4,345,714 | A | 8/1982 | Kojima | |
| 4,916,642 | A * | 4/1990 | Kaiser et al. | 700/278 |
| 5,054,686 | A | 10/1991 | Chuang | |
| 5,653,632 | A * | 8/1997 | Ogawa et al. | 454/343 |
| 5,682,949 | A | 11/1997 | Ratcliffe et al. | |
| 5,698,958 | A | 12/1997 | Domel et al. | |
| 5,713,156 | A | 2/1998 | Briggs | |
| 5,833,134 | A | 11/1998 | Ho et al. | |
| 5,918,417 | A | 7/1999 | Kinder | |

(Continued)

FOREIGN PATENT DOCUMENTS

| | | | |
|---|---|---|---|
| CN | 1890123 | A | 1/2007 |
| EP | 1160552 | A1 * | 12/2001 |
| WO | 2009136004 | A1 | 11/2009 |

OTHER PUBLICATIONS

Yu, Modeling Occupancy Behavior for Energy Efficiency and Occupants Comfort Management in Intelligent Buildings, 2010 Ninth International Conference on Machine Learning and Applications, 6 pages.

(Continued)

*Primary Examiner* — Alissa Tompkins
*Assistant Examiner* — Brittany Towns
(74) *Attorney, Agent, or Firm* — Procopio, Cory, Hargreaves & Savitch LLP; Noel C. Gillespie

(57) ABSTRACT

A motorized vent covering for an air vent of the environment control system, the motorized vent covering comprising an air flow restrictor for controlling air flow through the vent; and an actuator, the actuator including a motor configured to drive the air flow restrictor to control the flow of air from the vent, and a controller in communication with the motor, the controller configured to provide operating instructions to the motor to open or close the air flow restrictor to adjust the flow of air through the air vent.

17 Claims, 4 Drawing Sheets

(56) References Cited

U.S. PATENT DOCUMENTS

| | | | | |
|---|---|---|---|---|
| 6,324,008 | B1 | 11/2001 | Baldwin et al. | |
| 6,758,256 | B1 | 7/2004 | Garcia | |
| 6,967,565 | B2 | 11/2005 | Lingemann | |
| 7,024,282 | B2 | 4/2006 | Coogan et al. | |
| 7,058,477 | B1 | 6/2006 | Rosen | |
| 7,163,156 | B2 * | 1/2007 | Kates | 236/1 B |
| 7,272,452 | B2 | 9/2007 | Coogan et al. | |
| 7,389,806 | B2 | 6/2008 | Kates | |
| 7,417,397 | B2 | 8/2008 | Berman et al. | |
| 7,802,618 | B2 | 9/2010 | Simon et al. | |
| 7,865,252 | B2 | 1/2011 | Clayton | |
| 7,872,643 | B2 | 1/2011 | Galligan et al. | |
| 7,884,727 | B2 | 2/2011 | Tran | |
| 7,941,245 | B1 | 5/2011 | Popat | |
| 8,136,738 | B1 | 3/2012 | Kopp | |
| 8,214,084 | B2 | 7/2012 | Ivey et al. | |
| 2003/0139134 | A1 | 7/2003 | Bailey et al. | |
| 2004/0067731 | A1 * | 4/2004 | Brinkerhoff et al. | 454/325 |
| 2004/0159713 | A1 * | 8/2004 | Schmidt et al. | 236/49.3 |
| 2006/0044152 | A1 | 3/2006 | Wang | |
| 2006/0106499 | A1 | 5/2006 | Roosli et al. | |
| 2006/0286918 | A1 * | 12/2006 | Vargas | 454/155 |
| 2007/0119957 | A1 * | 5/2007 | Kates | 236/1 B |
| 2008/0083234 | A1 | 4/2008 | Krebs et al. | |
| 2008/0202135 | A1 * | 8/2008 | Francis | 62/157 |
| 2008/0258633 | A1 | 10/2008 | Voysey | |
| 2009/0065598 | A1 * | 3/2009 | Quirino et al. | 236/51 |
| 2009/0088067 | A1 | 4/2009 | Rimmer et al. | |
| 2010/0280667 | A1 | 11/2010 | Steinberg | |
| 2010/0286841 | A1 | 11/2010 | Subbloie | |
| 2010/0298957 | A1 | 11/2010 | Sanchez Rocha et al. | |
| 2011/0035061 | A1 | 2/2011 | Altonen et al. | |
| 2011/0066302 | A1 | 3/2011 | McEwan | |
| 2011/0077758 | A1 | 3/2011 | Tran et al. | |
| 2011/0166712 | A1 | 7/2011 | Kramer et al. | |
| 2011/0213500 | A1 | 9/2011 | Scharf et al. | |
| 2012/0086363 | A1 | 4/2012 | Golding et al. | |

OTHER PUBLICATIONS

Cleveland et al, Automating the Residential Thermostat Based on House Occupancy, Systems and Information Engineering Design Symposium, Apr. 23, 2010, 6 pages.

Office Action received in related Chinese patent application No. 201110112452.5, 17 pages. (including translation).

Second Office Action for Chinese Application No. 201110112452.5, dated May 26, 2015.

Third Office Action for Chinese Application No. 201110112452.5, dated Sep. 21, 2015 (9 pages).

* cited by examiner

SYSTEMS AND METHODS FOR A MOTORIZED VENT COVERING IN AN ENVIRONMENT CONTROL SYSTEM

BACKGROUND

1. Technical Field

The embodiments described herein are related to automated environment control system operation and more particularly, to systems and methods for controlling the operation of a motorized vents in an environment control system.

2. Related Art

Heating, ventilating, and air conditioning (HVAC) systems provide control over the indoor environment of buildings through heating, cooling, and air circulation. Rising energy costs have driven manufacturers to make an effort to make these systems more energy efficient; however, even the most energy efficient HVAC systems can still waste energy by heating or cooling unoccupied spaces within a building. For example, in a multi-story home, occupants may be downstairs during the day and move upstairs at night. Accordingly, it can be inefficient and costly to heat or cool the upstairs during the day and the downstairs at night.

Conventional HVAC systems have a central heating and cooling unit that pushes air into various rooms through ducts with outlets in the rooms. The outlets are typically covered by a vent covering that includes adjustable louvers. Accordingly, one could adjust the louvers to make heating and cooling more efficient, but this is time consuming and often difficult due to the location of the vent coverings.

Other multi-room buildings can also suffer from similar inefficiencies. For example, suites or other multi-room facilities in hotels can have multiple rooms or outlets controlled by a single heating and air conditioning unit. Office buildings also often have multiple offices or rooms controlled by a single unit.

Conventional HVAC systems do not provide the ability to control the flow of air such that it only goes to occupied portions of the building, or where it is needed.

SUMMARY

Systems and methods for an environment control system that includes a motorized vent covering configured to control the air flow into and/or out of a room through a vent are described herein.

In one aspect, a motorized vent covering for an air vent of the environment control system, the motorized vent covering comprising an air flow restrictor for controlling air flow through the vent; and an actuator, the actuator including a motor configured to drive the air flow restrictor to control the flow of air from the vent, and a controller in communication with the motor, the controller configured to provide operating instructions to the motor to open or close the air flow restrictor.

In another aspect, a motorized vent covering for an air vent of the environment control system, the motorized vent covering comprising a signal sensor configured to receive control signals; an air flow restrictor for controlling air flow through the vent; and an actuator, the actuator including a motor configured to drive the air flow restrictor to control the flow of air from the vent, and a controller in communication with the motor, the controller configured to provide operating instructions based on the control signals to the motor to open or close the air flow restrictor to adjust the flow of air through the air vent.

These and other features, aspects, and embodiments are described below in the section entitled "Detailed Description."

BRIEF DESCRIPTION OF THE DRAWINGS

Features, aspects, and embodiments are described in conjunction with the attached drawings, in which.

DETAILED DESCRIPTION

The following detailed description is directed to certain specific embodiments. However, it will be understood that these embodiments are by way of example only and should not be seen as limiting the systems and methods described herein to the specific embodiments, architectures, etc. In this description, reference is made to the drawings wherein like parts are designated with like numerals throughout.

The systems and methods disclosed herein provide an environment control system that includes a motorized vent covering that can be configured to control the flow or air into or out of a room through a vent. Rooms can include multiple vents that have motorized vent coverings. A motorized vent covering can include an air flow restrictor that can be opened and/or closed to control the air flow into or out of a room through the vent. The environment control system can be configured to automatically control the airflow into and/or out of rooms in order to more efficiently heat, cool, and/or ventilate the building, e.g., by only moving air into and/or out of rooms that are occupied. As a result, the HVAC systems can operate more efficiently by reducing energy usage and reducing utility costs.

According to some embodiments, the environment control system can be configured for use with a shared HVAC system that provides heating, cooling, and/or ventilation system to multiple rooms. For example, in an office building, a single HVAC system can provide HVAC services to several offices. In another example, a hotel can include multiple room suites or villas that have a single HVAC system that provides HVAC services to multiple rooms. In yet another example, a residence can include a single HVAC system that provides HVAC services to multiple rooms in the residence.

According to some embodiments, the environment control system can include a controller that is configured to receive data from environment sensors in the room or rooms and to control heating and cooling based on information received from the sensors. For example, the environment control system can use the data from the sensors to determine whether to activate a motor coupled to a motorized vent to open or close the vent in order to allow or restrict air flow through the vent. The environment control system can be configured to receive and process data from various different types of environment sensors, such as motion sensors and presence detectors to detect when an occupant is in a room, temperature sensors for detecting the temperature in a room, and/or light sensors for detecting the amount of light entering windows of a room. The environment control system can also be configured to receive and process data from other types of sensors that provide information about the environment in a room. Such embodiments are discussed in more detail below.

Figure 1:
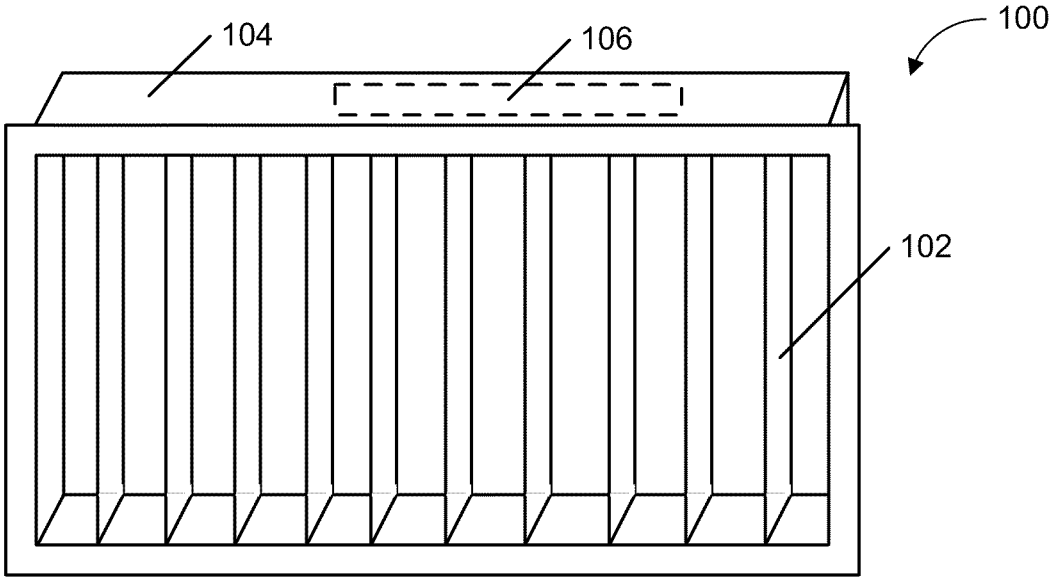
FIG. 1 is a diagram illustrating an example motorized vent covering in accordance with one embodiment.

FIG. 1 illustrates an example motorized vent covering 100. The motorized vent covering 100 comprises a frame 104 and covers the outflow of a HVAC vent (not shown) through which air from, e.g., a forced air heating and/or cooling system can enter the room. The motorized vent covering 100 can include a means for at least partially restricting and/or stopping the airflow from the forced air heating and/or cooling systems from entering the room. According to one embodiment, the HVAC system is a central HVAC system that provides heating or cooling to a residence or building or a portion thereof. The HVAC system can distribute heated or cooled air through supply ductwork installed in the building. Heated or cooled air can be distributed from the supply ducts and into rooms of the residence or building from vents installed in the ducts.

The motorized vent covering 100 can include an airflow restrictor for controlling air flow through the vent upon which the motorized vent covering 100 is mounted. In an embodiment, the air flow restrictor of the motorized vent covering 100 can comprise a set of louvers 102 that can be opened or closed to control the air flow from the vent into the room. According to another embodiment, the air flow restrictor of the motorized vent covering 100 can comprise a damper that can be opened or closed to control air flow from the vent. According to another embodiment, the motorized vent covering 100 can include pivotable louvers that can be configured to direct air flow from the vent in various the directions by pivoting the louvers.

According to some embodiments, an actuator 106 can be integrated into the frame 104 of motorized vent covering 100. In yet other embodiments, an existing non-motorized vent covering can be retrofitted with an actuator 106 to control the operation of the vent covering 100.

Actuator 106 can be configured to open or close the airflow restrictor. In embodiments where the environment control system includes multiple motorized vent coverings 100, each motorized vent covering 100 can include an actuator 106 for opening and closing the airflow restrictor of the motorized vent covering 100. According to an embodiment, the airflow restrictor can comprise a set of louvers, and the actuator 106 can be configured to actuate a shaft that is interfaced with a rod arm associated with one of the plurality of louvers 102 used to control the air flow from the motorized vent covering 100 and thereby activate all of the plurality of louvers 102 simultaneously via a linking apparatus that allows the louvers to be operated simultaneously.

Figure 2:
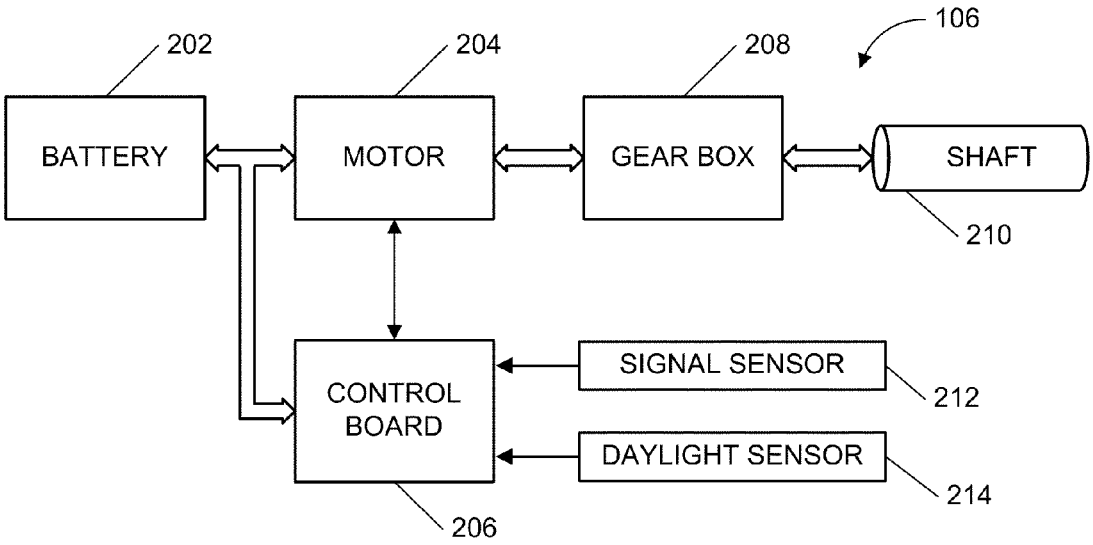
FIG. 2 is a diagram illustrating an example actuator for use in the motorized vent covering of FIG. 1.

FIG. 2 is a diagram illustrating an example actuator 106 in block form and in accordance with one embodiment. As can be seen, actuator 106 can comprise a power source such as rechargeable or non-rechargeable batteries 202 configured to supply power to a motor 204 and control board 206. Control board 206 can be a circuit board and can include circuits, such as a microprocessor (not shown) for controlling the operation of actuator 106. For example, the circuits on control board 206 can be configured to activate and deactivate motor 204. Motor 204 can be interface with gear box 208, which can be configured to activate a shaft 210 that in turn can be interface with a mechanism that controls the position of, e.g. louvers 102.

Actuator 106 can also include a sensor 212 coupled with control box 206 and configured to receive command signals for operating actuator 106. In this way, actuator 106 can be controlled via remote control, allowing for easy operation of motorized vent covering 100. Sensor 212 can be configured to receive radio frequency or optical, e.g., Infrared, command signals.

Figure 3:
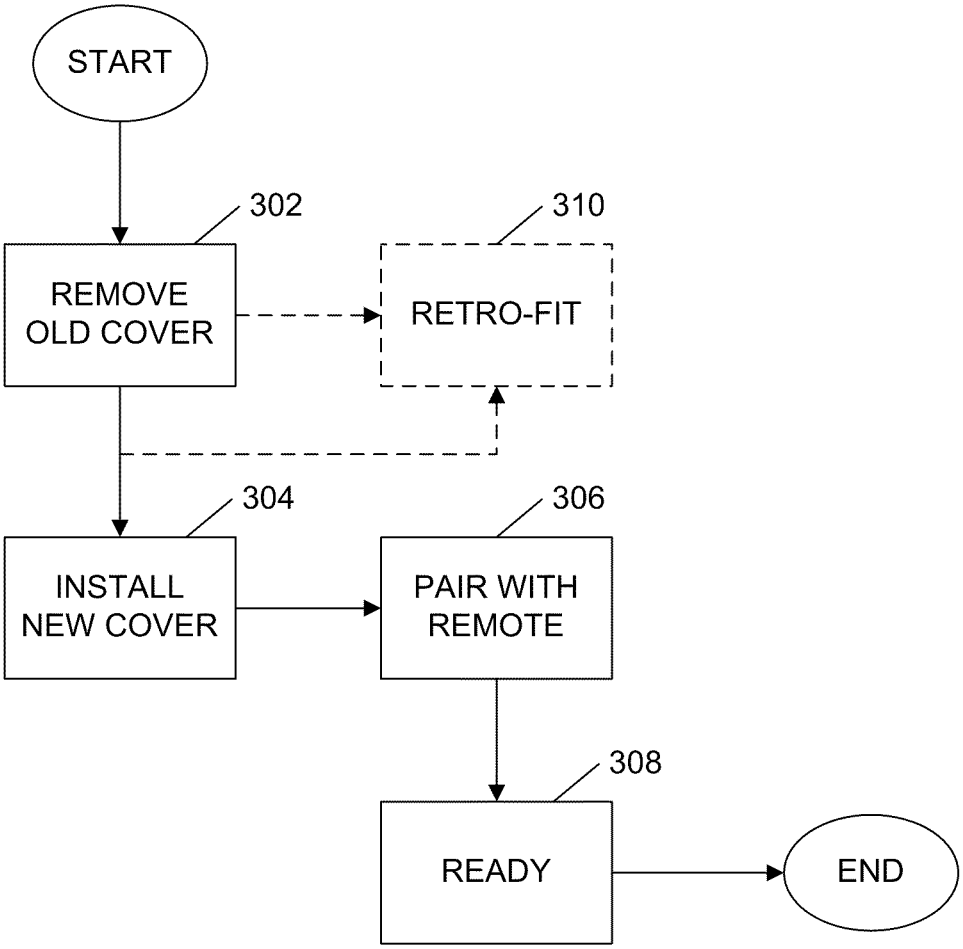
FIG. 3 is a flow chart illustrating an example process for upgrading a room to include the motorized vent covering of FIG. 1.

Often some configuration is required in order to pair actuator 106 with an applicable remote and to calibrate the operation of, e.g., louvers 102. FIG. 3 is a flow chart illustrating the installation and configuration of a motorized vent covering 100. First, in step 302 the old vent covering is removed. Then, in step 304, a motorized vent covering 100 is installed in place of the old vent covering. Then in step 306, a remote control is paired with the automated vent covering 100 causing any calibration operations for actuator 106 to take place. The automated vent covering 100 is then ready for operation under the control of the remote in step 308.

Accordingly, if a home owner replaced all of the vents in his house with automated vent coverings 100, then the owner can use the remote to close vents upstairs during the day and open them at night. The owner can also open vents downstairs during the day and close them at night. This can allow for more efficient and less costly heating and air conditioning of the house. The same principles can be used to control heating and cooling in any multi-room, or multi-vent building including hotel rooms, meeting rooms, office buildings, etc.

For example, the systems and methods described can be used in a multiple room unit, such as a suite, where the multiple room unit has a dedicated HVAC system. The automated vent covering 100 can be used to control air flow into and out of rooms based in part on the occupancy by closing vents at least part of the time in unoccupied rooms of the multiple room unit in order to save energy and reduce utility bills.

In another example, the automated vent covering 100 can be configured for use with multiple offices in an office building that share an HVAC system. In many office buildings, several offices can share an HVAC system that provides heating, cooling, and/or ventilation to each of the offices. In a typical configuration, one of the offices includes a thermostat for selecting a temperature at which the HVAC system will attempt to maintain the offices that share the HVAC system. This configuration can lead to discomfort and disagreements between occupants of these offices if the occupants cannot reach a consensus on as to what is a comfortable temperature. A temperature that one occupant finds comfortable may be too hot or too cold for an occupant of another office.

The automated vent covering 100 can be configured to allow occupants of an office to adjust the airflow from the HVAC system into and/or out of their office. For example, an occupant that was overheated could instruct the automated vent covering 100 to close the motorized vent covers in her office to divert heat from the HVAC system away from her office. Similarly, if the occupant was cold, she could instruct the automated vent covering 100 to close the motorized vent covers in her office to divert cool air from the HVAC system away from her office. For example, the environment control system can include a remote control that sends a signal instructing the automated vent covering 100 to close the motorized vents in the room.

As mentioned, in certain embodiments, actuator 106 can be included in a kit for retro-fitting existing vents. Thus, the process of FIG. 3 may include a step of retrofitting the vent in step 310. Such a kit can include brackets and mounting hardware for mounting actuator 106 in frame 104 and linking hardware for linking shaft 210 with, e.g., louvers 102 and possible linking louvers 102.

Use of batteries and the ability for remote operation, allows a conventional, non-motorized vent covering of an existing HVAC system to be replaced with motorized vent covering 100 without requiring the installation of wires to deliver a control signal or power to actuator 106 or requiring manual operation of the motorized vent covering 100. It should be noted that in accordance with some embodiments, the environment control system can include a manual override that allows an occupant of a room to override the system in order to manually adjust the air flow through the vent.

In other embodiments, as described below, actuator 106 can be coupled with environmental sensors, such that it operates in response to, e.g., changing light conditions, increasing the automation of motorized vent covering 100. For example, a daylight sensor 214 can be included in or coupled to actuator 106 to allow remote operation and or automated operation based on daylight conditions. For example, the daylight sensor 214 can be configured to generate a signal to cause the actuator 106 to open, e.g., louvers 102 during daylight hours in order to provide HVAC services to a particular room. Such a configuration can be desirable in an office building where the room is an office that is typically occupied during daylight hours. The daylight sensor can thus cause the HVAC services to be directed into the office during daylight hours.

Inclusion of a daylight sensor can require configuration of the sensor or actuator 106 in order to dictate what actions to take in response to a signal from the daylight sensor 214, e.g., should the louvers open, close, open a little, close a little, etc.

Similarly, a time of day sensor, such as a clock can be include in or interfaced with actuator 106 in order to allow automated control of the air flow based on the time of day. Again, this can take some configuration in order to provide the proper control at the proper time of day.

Thus, the motorized vent covering 100 can be configured to close vents in one or more rooms based on time of day, occupancy, temperature, and/or other factors. For example, the motorized vent covering 100 can be configured to reduce the airflow through the motorized vents in the bedrooms of a home during the day when the bedrooms are likely to be unoccupied. The motorized vent covering 100 can also be configured to open the motorized vents of the bedrooms at night when the bedrooms are likely to be occupied and to close the motorized vents or reduce the airflow through the motorized vents in rooms, such as the living room, dining room, and kitchen, that are not as likely to be occupied to during the night. As a result, less energy should be required to operate the HVAC system to heat or cool parts of the residence that not likely to be occupied.

In certain embodiments, motorized vent covering 100 can be integrated into a larger environmental control system. Such a system, for example, can be configured to control the position of window coverings, the operation of the HVAC system, operation of lighting, etc.

Figure 4:
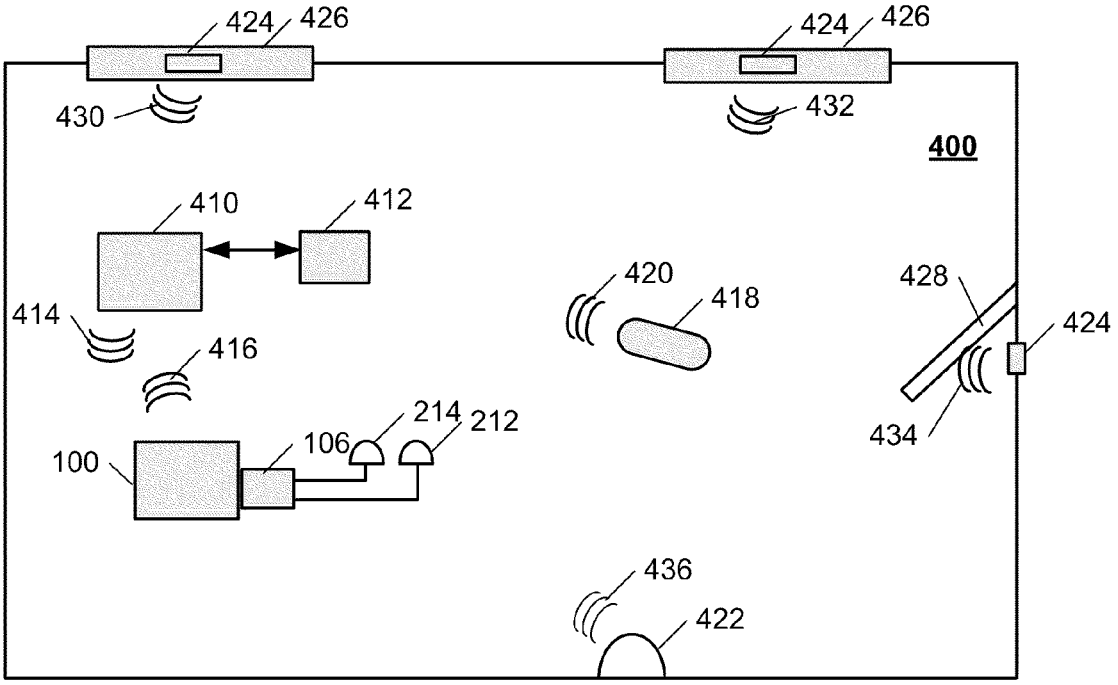
FIG. 4 is a diagram illustrating an example environment control system that can include the motorized vent covering of FIG. 1 in accordance with one embodiment.

For example, FIG. 4 illustrates an example environment control system 400 that includes a motorized vent covering 100 according to an embodiment. In the embodiment illustrated in FIG. 4, the environment control system 400 is configured to control a single room; however, it will be apparent that system 400 can be configured to provide coordinated environmental control for multiple rooms within a building.

System 400 comprises a controller 410, which can include a processor or controller as well as the components, hardware and software; sensors; data storage; etc., needed to control, e.g., lighting, temperature, etc., within the room. Controller 410 can be interfaced wired or wirelessly with a temperature sensor 412, which can provide temperature information to controller 410. In addition, system 400 can include a presence detector 422 configured to detect the presence of someone in the room as well as motion sensors 424 interfaced with windows 426 and door 428. Sensors 424 can be configured to detect wither windows 426 or door 428 have been opened or closed.

Motorized vent covering 100 can include frame 104, actuator 106, and sensors 212 and 214 coupled with actuator 106, which can be configured to operate in response to information provided by sensors 212 and 214. Thus, for example, a remote control 418 can be configured to provide control signals 420 to signal sensor 212 to thereby control the operation of actuator 106, or more specifically the position of the louvers 102 of the motorized vent covering 100.

Signals 420 can be optical control signals or radio signals depending on the embodiment.

Additionally, actuator 106 can be in communication via signals 414 and 416 with a controller 410. Actuator 106 can, therefore, be coupled with a communications module (not shown) configured to generate signals 416 and/or receive signals 414. Signals 414 and 416 can be optical or radio signals. Thus, the communication module can be configured to generate and/or receive the appropriate type of signal. It will be understood that actuator 106, sensors 212 and 214, and/or the communications module can be included in a single housing or as separate units depending on the embodiment.

Daylight sensor 214 can then be communicatively coupled with controller 410, either directly or via actuator 106, or more specifically the communications module. Similarly, any, all, or a combination of a temperature sensor 412, motion sensors 424, daylight sensor 214, sensor 212, and presence detector 422 can be communicatively coupled with controller 410 either via a wired or wireless interface. In the example of FIG. 4, temperature sensor 412 is shown as being connected via a wired connection with controller 410, while motion detectors 424 and presence detector 422 are illustrated as being coupled with controller 410 via wireless communication signals 430, 432, 434, and 436. Again, signals 430, 432, 434, and 436 can be optical or radio signals depending on the embodiment.

In an embodiment, the temperature sensor 412 can comprise a programmable thermostat. The programmable thermostat can provide a user interface that allows the building management and/or the room occupants to set a preferred temperature for the room in which the thermostat is installed. The programmable thermostat can be configured to generate a signal that causes the actuator 106 to open or close the motorized vent covering 100 if the temperature of the room falls below or rises above the preferred temperature. In an embodiment, the programmable thermostat can be programmed with a preferred temperature range for the room that includes an upper and lower threshold.

The programmable thermostat can be configured to generate a signal that causes the actuator 106 to open or close the motorized vent covering 100 if the temperature of the room falls below or rises above the preferred range. In another embodiment, the programmable thermostat can be programmed with a preferred temperature range for when the room is occupied and a preferred temperature range when the room is unoccupied. As a result, the temperature of the room can be maintained within a first temperature range when the room is occupied and within a second temperature range when the room in unoccupied in order to conserve energy.

In some embodiments, the temperature sensor 412 can comprise a programmable thermostat that controls the temperature of multiple rooms of a building. In one example, multiple offices in an office building share the same HVAC unit and the programmable thermostat is located in one of the office. The occupant of the office in which the programmable thermostat is located can control the temperature of the offices that share the HVAC unit by setting a preferred temperature or temperature range on the programmable thermostat. The occupant of an office that does not include the programmable thermostat can still exercise some control over the temperature within the office by instructing the motorized vent covering 100 in their office to adjust the air flow in their office. For example, the occupant can instruct the motorized vent covering 100 to open and/or close the vents in his or her office using remote control 418.

In one embodiment, the remote control 418 can be a wall-mounted device that includes controls that allow the occupant of the office to instruct the motorized vent covering 100 to adjust the air flow. Not only does this allow the occupant of an office that does not include a programmable thermostat to exercise some control over the temperature within their office, this can also conserve energy by only using the HVAC to heat and cool those offices where the HVAC services are desired.

Returning now to FIG. 4, motion detectors 424 can be configured to detect the status of windows 426 and door 428, e.g., in order to detect whether someone has entered the room or whether one of the windows or door is open. Presence detector 422 can be configured to detect whether an individual is in the MOM.

Controller 410 can then be configured to control the operation of actuator 106 based on the inputs from the various systems. This control can be part of a larger control program to control the environment, e.g., lighting and temperature within the room and/or within multiple rooms of a multiple room building. For example, controller 410 can be configured to open or close the motorized vent covering 100 to adjust the temperature of the room to fall within a first preferred range if an occupant is detected in the room by motion detectors 424 and/or presence detector 422. The controller 410 can also be configured to open or close the motorized vent covering 100 to adjust the temperature of the room to fall within a second preferred range when no occupant is detected within the room. For example, if no occupant is detected in the room for at least five minutes, the controller 410 can be configured to maintain the room temperature at the second preferred range. In an embodiment, the length of time for determining when to switch to the second preferred temperature range can be configured by the building administrator.

For example, controller 410 can also be configured to control the temperature in the room in part by controlling the position of window coverings on the windows 426, based on the time of day, amount of light entering the room or incident on one of windows 426, the temperature, or some combination thereof. In an embodiment, the windows can have window coverings, such as shades, blinds, or curtains, and the window coverings comprise a motor that can be controlled by controller 410 to open or close the window coverings to control the amount of light entering the room.

In another example, e.g., depending on the time of day, controller 410 can be configured to control actuator 106 to control the motorized vent covering 100, when someone enters the room. For example, if someone enters the room, as detected by the associated motion detector 424 and/or presence detector 422, then controller 410 can be configured to open motorized vent covering 100 to allow heated or cooled air from the HVAC system into the room. This is not only convenient for the person entering the room (as they do not have to adjust the thermostat or turn on the air conditioning or heat), but can also save electricity if by not heating or cooling the room while the room is unoccupied. For example, airflow through vents in unoccupied offices in an office building can be adjusted by at least partially closing the motorized vents in the unoccupied offices, or airflow to unoccupied portions of a residence can be reduced by at least partially closing the vents to the unoccupied rooms of the residence.

In an embodiment, the controller 410 can be configured to monitor the temperature of a room to keep the temperature of the room within a preferred temperature range while the room is unoccupied. If the temperature of the room rises above the preferred range, the controller 410 can be configured to open motorized vent covering 100 to allow cooled air from the HVAC system into the room and the temperature of the room rises above the preferred range controller 410 can be configured to open motorized vent covering 100 to allow heated or cooled air from the HVAC system into the room. Thus, the temperature of the room can be maintained within a range where that can easily be heated or cooled to a comfortable temperature when an occupant enters the room.

According to an embodiment, the controller 410 can be configured to close the motorized vent coverings 100 in a room during predetermined time periods where the room is likely to be unoccupied. For example, the controller 410 can be configured to close the motorized vent coverings 100 on vents of a classroom at night where students and teachers are not likely to be present. In another example, the controller 410 can be configured to close the motorize vent coverings 100 in rooms of a residence that are unoccupied or to close the motorized vent coverings 100 in rooms that are not likely to be occupied during certain parts of the day. For example, the controller 410 can be configured to at least partially close the motorized vent covers 100 of the vents in the bedrooms of a residence during the day when the bedrooms are likely to be unoccupied.

According to an embodiment, the controller 410 can include a manual override that allows an occupant to override the current system settings. According to an embodiment, the temperature sensor 412 can be a programmable thermostat, and the room occupant can override the current settings for the room by adjusting the temperature on the programmable thermostat. As a result of the occupant's override, the motorized vent coverings 100 can be opened or closed to adjust the temperature and/or air flow into the room according to the occupant's preferences. According to an embodiment, the occupant can also override the current system settings using remote control 418. For example, as described above, an occupant of an office can manually override the settings of the environment control system 400 and instruct the controller 410 to open and/or close the vents in his or her office using remote control 418. In one embodiment, the remote control 418 can be a wall-mounted device that includes controls that allow the occupant of the office to instruct the controller 410 to adjust the air flow through the motorized vents 100.

According to another embodiment, the associated motion detector 424 and/or presence detector 422 can be used to override the current settings for a room if an occupant is detected in the room. For example, if a classroom is being used for an event that is scheduled outside of regular operating hours when the environment control system would typically turn off heating and cooling to the classroom, the system can be configured to override the programming and provided heating and cooling to the room if the associated motion detector 424 and/or presence detector 422 detect that the room is occupied.

Further, upon detection that the occupant has left, controller 410 can be configured to control, e.g., actuator 106 and the motorized vent covering 100 to limit heated or cooled air from entering the room when no one is in the room. This can, for example, lower heating and/or cooling costs by redirecting air conditioned air away from the room when the room is unoccupied so that the heated or cooled air can be redirected to occupied portions of the building where the heated or cooled air is needed.

According to some embodiments, the room can include multiple vents that each comprises a motorized vent covering 100. For example, in one embodiment, a room may have a vent located near the floor and a vent located near the ceiling and both vents have a motorized vent covering 100 mounted thereon. In an embodiment, when the HVAC system is heating the room, the motorized vent covering 100 of the vent located near the ceiling can be closed and the motorized vent covering 100 of the vent located near the floor can be opened. This would allow the warm air produced by the HVAC system to enter the room near the floor and rise toward the ceiling in order to heat the room. For example, the controller 410 can be configured to generate a control signal to cause the actuator 106 of the motorized vent covering 100 of the vent located near the ceiling to close the air flow restrictor of the motorized vent covering 100, and the controller 410 can be configured to generate a control signal to cause the actuator 106 of the motorized vent covering 100 of the vent located near the floor to open the air flow restrictor of the motorized vent covering 100.

When the HVAC system is cooling the room with cool air, the motorized vent covering 100 of the vent located near the floor can be closed and the motorized vent covering 100 of the vent located near the ceiling can be opened. This would allow the cool air produced by the HVAC system to enter the room near the ceiling and fall toward the ceiling in order to heat the room. For example, the controller 410 can be configured to generate a control signal to cause the actuator 106 of the motorized vent covering 100 of the vent located near the ceiling to close the air flow restrictor of the motorized vent covering 100, and the controller 410 can be configured to generate a control signal to cause the actuator 106 of the motorized vent covering 100 of the vent located near the floor to open the air flow restrictor of the motorized vent covering 100. As a result, the room can more effectively been heated or cooled by forcing air conditioned air into the upper or lower portion of the room where the air conditioned air can have the most impact on the temperature of the room.

It will be understood that a variety of heating, cooling, lighting, etc., control programs can be implemented by controller 410 based on the various inputs to controller 410 and based at least in part by control of actuator 106. It will also be understood that controller 410 can also be interfaced with not only with a heating and cooling system as described above but can also be interface with an artificial lighting system to control such systems based on the various sensor inputs. For example, if the motion detector at the door detects that an occupant has entered a room, a light or lights in the room may be turned on and vents in the room opened to allow the HVAC system to heat or cool the room.

In an embodiment, the controller 410 and/or the programmable thermostat 412 can receive control signals from a central control computer system (not shown). The central control computer system can be configured to allow a building administrator to define environmental control settings for one or more rooms in a multi-room building, such as a hotel or office building. This would allow the building administrator to develop a comprehensive HVAC plan for the building, where occupancy, sensor data, and other considerations such as time of day and/or date could be used to control which parts of the building are heated or cooled and which parts of the building should not receive HVAC services. For example, in some embodiments, the environment control system 400 can be installed in a residence, and the central control system can be a personal computer system such as a laptop computer that can be configured to interface with the environment control system 400 via a wired or a wireless connection. A user can configure the environment control system 400 to adjust the airflow through vents in various parts of the residence based on various parameters, such as time of day, temperature, and/or other parameters based on sensor data received from the environment sensors and/or via other sources.

According to an embodiment, existing non-motorized vent covers for a HVAC system can be retrofitted with a motor, such as actuator 106 described above, and the actuator 106 can be controlled via controller 410, using a remote control, such as remote control 418 described above, and/or through various methods described in the various embodiments disclosed here. For example, conventional non-motorized vent covers in a residence can be modified to include a motor that can operate the vent covers to open and close the vent covers in accordance with the various embodiments described above. In one embodiment, the retrofitted vent covers may include a sensor coupled to the actuator 106 for receiving signals from a remote control 418, and the remote control 418 is configured to generate signals that allows the user to selectively open and or close the retrofitted vent covers. The sensor can receive signals from the remote control 418 and activate the motor to open, close, or partially open or close the retrofitted vent cover. In another example, a conventional non-motorized vent in an office can be retrofitted to include a actuator 106 and a sensor coupled to the actuator 106 for receiving signals from a remote control 418, and the remote control 418 is configured to generate signals that allows an occupant of the office to selectively open and or close the retrofitted vent cover using the remote.

While certain embodiments have been described above, it will be understood that the embodiments described are by way of example only. Accordingly, the systems and methods described herein should not be limited based on the described embodiments. Rather, the systems and methods described herein should only be limited in light of the claims that follow when taken in conjunction with the above description and accompanying drawings.

What is claimed is:

1. An environment control system comprising a window sensor and a motorized vent covering, the motorized vent covering comprising:

an air flow restrictor for controlling the amount of air flow through an air vent; and an actuator, the actuator including:

a motor driving the air flow restrictor to control the flow of air from the vent, and a controller in communication with the motor, the controller providing operating instructions to the motor to open or close the air flow restrictor to adjust the amount of air flow through the air flow vent;

wherein the controller determines the operating instructions based at least in part upon a signal output from the window sensor and a daylight sensor, wherein the window sensor detects whether a window has been opened or closed, and the daylight sensor detects changing light conditions, and wherein the controller controls room temperature by implementing the operating instructions by controlling the position of window coverings on the window based on the amount of light entering the window and controlling the air flow restrictor between an open, closed, partially opened, and partially closed position corresponding to the signal from the daylight sensor and the status of the window to control the amount of air flow from the vent.

2. The environment control system of claim 1, wherein the actuator further includes a power source configured to supply power to the motor and the controller.

3. The environment control system of claim 2, wherein the power source is a battery.

4. The environment control system of claim 1, wherein the motorized vent covering further comprises a signal sensor configured to receive control signals, and wherein the controller is further configured to control operation of the motor based on the control signals.

5. The environment control system of claim 4, wherein the control signals are infrared control signals.

6. The environment control system of claim 4, wherein the control signals are radio frequency control signals.

7. The environment control system of claim 1, wherein the daylight sensor is coupled with the actuator.

8. The environment control system of claim 1, further comprising a temperature sensor coupled with the controller, and wherein the controller controls operation of the actuator in response to temperature data provided by the temperature sensor.

9. The environment control system of claim 1, wherein the air flow restrictor comprises a plurality of louvers, and wherein the actuator further comprises a shaft coupled with the motor and configured to drive the plurality of louvers.

10. An environment control system comprising a window sensor and a motorized vent covering, the motorized vent covering comprising:

a signal sensor configured to receive control signals;

an air flow restrictor for controlling the amount of air flow through an air vent; and an actuator, the actuator including:

a motor driving the air flow restrictor to control the flow of air from the vent, and a controller in communication with the motor, the controller providing operating instructions based on the control signals to the motor to open or close the air flow restrictor to adjust the amount of air flow through the air flow vent;

wherein the controller determines the operating instructions based at least in part upon a signal output from the window sensor and a daylight sensor, wherein the window sensor detects whether a window has been opened or closed, and the daylight sensor detects changing light conditions, wherein the controller controls room temperature by implementing the operating instructions by controlling the position of window coverings on the window based on the amount of light entering the window and controlling the air flow restrictor between an open, closed, partially opened, and partially closed position corresponding to the signal from the daylight sensor and the status of the window to control the amount of air flow from the vent.

11. The environment control system of claim 10, wherein the actuator further includes a power source configured to supply power to the motor and the controller.

12. The environment control system of claim 11, wherein the power source is a battery.

13. The environment control system of claim 10, wherein the control signals are infrared control signals.

14. The environment control system of claim 10, wherein the control signals are radio frequency control signals.

15. The environment control system of claim 10, wherein the daylight sensor coupled with the actuator.

16. The environment control system of claim 10, further comprising a temperature sensor coupled with the controller, and wherein the controller controls operation of the actuator in response to temperature data provided by the temperature sensor.

17. The environment control system of claim 10, wherein the air flow restrictor comprises a plurality of louvers, and wherein the actuator further comprises a shaft coupled with the motor and configured to drive the plurality of louvers.

* * * * *

UNITED STATES PATENT AND TRADEMARK OFFICE

CERTIFICATE OF CORRECTION

PATENT NO. : 9,322,569 B2
APPLICATION NO. : 12/772900
DATED : April 26, 2016
INVENTOR(S) : Richard Scharf It is certified that error appears in the above-identified patent and that said Letters Patent is hereby corrected as shown below:

Title Page, Item 73; Assignee, "Harmonic Design, Inc." should read --Somfy Systems, Inc.--

Signed and Sealed this
Twelfth Day of July, 2016

Michelle K. Lee

Michelle K. Lee
*Director of the United States Patent and Trademark Office*